United States Patent [19]

de Moreau

[11] 3,982,754

[45] Sept. 28, 1976

[54] APPARATUS FOR CONSTRUCTING STRUCTURES, PARTICULARLY FOR CHILDREN'S PLAYGROUNDS AND GARDENS

[76] Inventor: Guy de Moreau, Vuurgatstraat 46, 1900 Overijse, Belgium

[22] Filed: May 23, 1975

[21] Appl. No.: 580,358

[30] Foreign Application Priority Data

May 27, 1974 Belgium ..... 815567

[52] U.S. Cl. ..... 272/113; 272/112; 46/29; 272/61

[51] Int. Cl.[2] ..... A63B 17/00

[58] Field of Search ..... 272/60 R, 62, 63, 56.5, 272/109, 110–113, 85, 100–108; 46/29; 297/440; 108/111, 101

[56] References Cited

UNITED STATES PATENTS

| | | | |
|---|---|---|---|
| 2,208,049 | 7/1940 | Pajeau | 46/29 |
| 2,704,667 | 3/1955 | Sanders | 272/60 R |
| 3,066,982 | 12/1962 | Brower | 297/440 |
| 3,097,615 | 7/1963 | Ross | 108/111 X |
| 3,814,416 | 6/1974 | Munger et al. | 272/60 R |
| 3,853,074 | 12/1974 | Madey | 108/111 X |

*Primary Examiner*—Richard C. Pinkham
*Assistant Examiner*—William R. Browne
*Attorney, Agent, or Firm*—Robert E. Burns; Emmanuel J. Lobato; Bruce L. Adams

[57] ABSTRACT

Apparatus for constructing structures, particularly for children's playgrounds and gardens, includes a number of different types of elements, namely first elements in the form of logs having spaced parallel bores, second elements in the form of bars which are threaded at their ends and can be passed through the bores, third elements in the form of spacer tubes which pass over the bars and have an outer diameter greater than that of the bores, and fourth elements which can be screwed onto the ends of the bars and have an outer diameter greater than that of the bores. The logs, when in use, are positionable to various positions radially from the bars. The fourth elements engage the spacers and prevent the spacers and the logs from moving axially on the second elements or bars.

7 Claims, 7 Drawing Figures

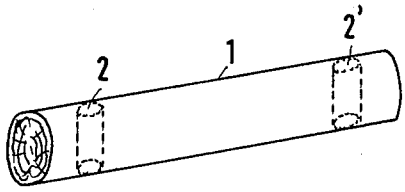
Fig.1
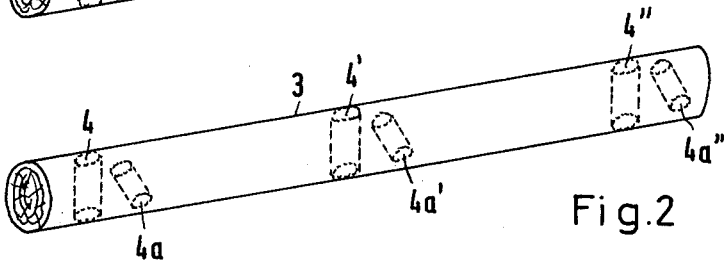
Fig.2
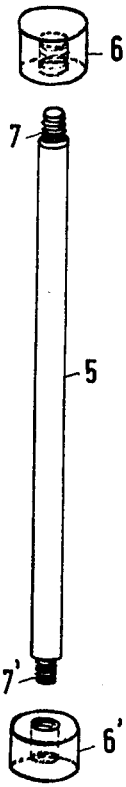
Fig.3
Fig.4
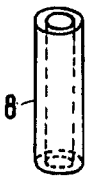

APPARATUS FOR CONSTRUCTING STRUCTURES, PARTICULARLY FOR CHILDREN'S PLAYGROUNDS AND GARDENS

BACKGROUND OF THE INVENTION

This invention relates to apparatus including sets of elements of simple, modular construction which may be assembled to form various different structures for use in children's playgrounds and which, with the aid of ancillary materials such as boards, ropes and the like, enable devices such as swings, trapezes, rings, climbing towers and slides to be produced. The apparatus may also be used to construct garden furniture, such as tables, benches and fences, either separately or in combination.

The basic elements of an illustrative embodiment of the invention are logs of undressed timber of approximately equal length, generally of decorticated and treated pine or fir, all of the logs being of more or less the same section or having been brought mechanically to the same section. Through each log passes one pair of holes of modular diameter which are parallel to each other and situated in a single plane. The holes are spaced by a constant, modular distance. The apparatus also includes a plurality of bars, the diameter of which is less than the diameter of the holes through the logs, spacer tubes of varying lengths but with an external diameter exceeding that of the holes and an internal diameter exceeding that of the bars, and internally threaded members capable of being screwed onto the two ends of the bars.

The apparatus may also include further logs of more or less similar cross-section to those mentioned above but having approximately twice their length. Each of the further logs has at least one group of three parallel holes situated in a common plane at modular spacings from one another identical to the spacing between the holes in the first logs. The apparatus may also include bars which are twice the length of the first mentioned bars, or means for securing one first bar to another in end-to-end relationship.

DESCRIPTION OF DRAWINGS

FIG. 1 shows a construction element in the form of a log;

FIG. 2 shows a construction element in the form of a log having a length twice that of the log shown in FIG. 1;

FIG. 3 shows a junction bar with a pair of end stops;

FIG. 4 shows a spacer tube;

DESCRIPTION OF PREFERRED EMBODIMENT

Figure 5:
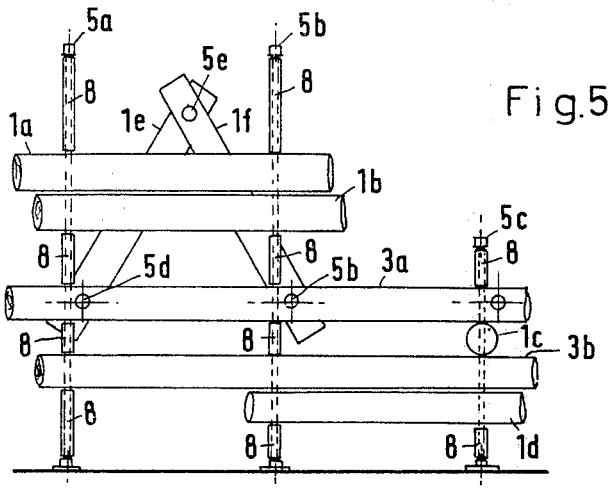
FIG. 5 is a side view showing various modes of interconnecting elements.

Referring to FIG. 1, a first or basic element 1 is in the form of a log provided with one pair of holes 2, 2′ parallel to each other and disposed in a single plane. The distance between the holes 2 and 2′ is modular and identical for all of the basic elements 1. Referring to FIG. 2, an element in the form of a log having a length approximately twice that of the log 1 has two groups of three holes 4, 4′, 4″ and 4*a*, 4′*a*, 4″*a*. The holes in each group are parallel and disposed in a respective plane.

The distance between the central hole in each group and each of the other holes in that group is equal to the distance between the holes 2 and 2′.

Although the log 3 is shown to have two groups of three holes, it is also possible to provide two pairs of holes in the log 1. Referring to FIG. 3, a junction bar 5 has screw threaded ends 7, 7′ onto which may be screwed end stops 6, 6′ having internally threaded blind or through bores.

The external diameter of the bar 5 is less than the diameter of the holes 2, and also less than that of all the other holes 2′, 4′, 4″ and so on, while the external diameter of the end stops is greater than that of the holes. Each of all or some of the bars may have integral end stop at one of its ends, possibly formed with a screw threaded bore into which the end of another bar 5 may be screwed.

The length of the bars 5 may vary, but preferably several sets of such bars of single, double and treble length, and so on, are provided. Alternatively screw threaded or other means separate or integral with the bars may be provided to enable the bars to be secured end to end. FIG. 4 shows a spacer tube 8 which has a sufficiently large internal diameter to permit the bars 5 to be passed therethrough but an external diameter greater than the diameter of the holes 2, 2′, 4 and so on, so that it can space apart two logs through which a bar bearing the spacer, is passed. The lengths of these spacers may vary, but preferably several sets of such spacers of single, double and treble length, and so on are provided. Tubes of single length may be equal to the log diameter. It is also possible to make use of a long tube, which is cut to size to form spacers in situ.

FIG. 5 shows a structure supported by vertically extending bars 5*a*, 5*b*, 5*c* and including a horizontal assembly formed by shorter logs 1*a*, 1*b*, 1*c*, 1*d*, longer logs 3*a*, 3*b*, and spacer tubes 8. Supported on the horizontal assembly by bars 5*d*, 5*e*, 5*f*, is a vertical assembly formed with shorter logs 1*e*, 1*f*.

As will be appreciated, the possibility of forming numerous, different structures using the same elements is extremely great and gives full rein to the creative imagination of children. It will also be noted, as shown in FIG. 5, that whereas the distance between the holes is modular and identical, the lengths of the logs may vary as can the positions of the pairs of holes in the logs, in order to avoid monotony and excessive symmetry.

Figure 7:
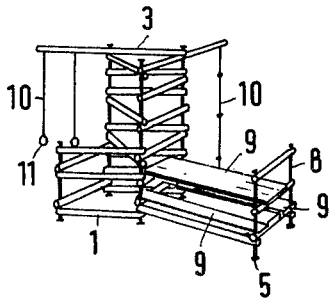
FIG. 7 shows a structure produced with the aid of the elements and simple ancillary materials.
Figure 6:
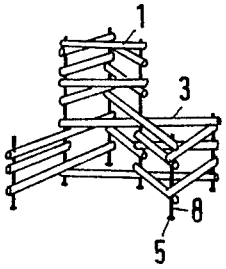
FIG. 6 shows a structure produced solely with the aid of the elements.

FIG. 6 shows a structure produced using solely the elements described above, that is logs 1, logs 3, bars 5 of two different lengths, and spacer tubes 8, whereas FIG. 7 shows a structure in which use has also been made of simple accessories, namely planks 9, ropes 10 and rings 11.

What I claim is:

1. For use in assemblying structure for children's playgrounds, gardens and the like, the combination comprising, a. a plurality of first elements of substantially equal cross section, each first element consisting of a log of undressed timber each having a pair of transverse bores disposed in a common plane passing longitudinally of the respective log, said bores being spaced on each first element a same predetermined modular distance and each having a same predetermined modular diameter, b. a plurality of second elements each consisting of a bar having threaded opposite ends and each having a diameter less than the diameter of the bores of the first elements for being received in use in a corresponding bore of the first elements extending therethrough, c. a plurality of tubular third elements of various equal lengths each having an axial through bore having a diameter greater than the diameter of said second elements for receiving in use the second elements extending axially therethrough, each third element having an outer diameter greater than the diameter of each transverse bore of the first elements, d. a plurality of fourth elements having a threaded bore for threading on to a respective threaded end of said second element and having an outer diameter greater than that of the transverse bores of the first elements, said fourth elements, when in use, bearing against third elements to limit movements of third and first elements on the second elements, e. whereby the first and second elements may be assembled in use in an assemblage with second elements upstanding extending through transverse bores of first elements so that said first elements span the distance between the second elements, said third elements are assembled in use axially spaced on the second elements intermediate at least some next adjacent first elements for spacing first elements axially on the second elements, and the fourth elements may be assembled threaded on outermost ends of the second elements, said first elements on said second elements being positionable to extend in radial directions from the second elements, and at least one of the second elements being positionable to extend axially through aligned transverse bores of all the first elements.

2. The combination according to claim 1, including a plurality of fifth elements of substantially equal cross section each, fifth element consisting of a log of undressed timber of approximately twice the length of the first elements each fifth element having at least one of three holes each axially spaced thereon, the distance between an intermediate hole and other holes of the groups being equal to the modular distance between the holes in the first elements, and said holes being dimensioned for receiving second elements extending therethrough.

3. The combination according to claim 2, including a plurality of sixth elements similar to the second elements and each having a length twice the length of the second elements.

4. The combination according to claim 1, in which each third element has a length which is an integral multiple of the diameter of the first elements.

5. The combination according to claim 1, in which the bore of each fourth element comprises a through bore for threading onto the second element threaded ends for connecting thereof.

6. A structure for children's playgrounds, gardens and the like comprising, in combination, a plurality of first elements of substantially equal cross section and equal length, each first element consisting of a log of undressed timber each having a pair of parallel transverse bores extending through the longitudinal axis of said first element and spaced axially equally in each of the first elements, a plurality of spaced apart upstanding rod-like second elements extending axially through aligned transverse bores of the first elements, third elements maintaining spaces between the first elements on the second elements, said second elements each having opposite threaded ends, some of the first elements extending radially from the second elements in corresponding directions, others of said first elements being disposed and displaced vertically from said some of said first elements and generally extending in other radial directions, at least one of the second elements extending axially through aligned transverse bores of all of the first element, and threaded stop elements on said threaded ends of said second elements to limit movements of first and third elements axially on said second elements.

7. A structure for children's playgrounds, gardens and the like, in combination, according to claim 6, including fifth elements similar to the first elements and having twice the length, each fifth element having three transverse bores axially spaced thereon and in a common plane, the distance between a middle bore and each other bore corresponding to the modular distance of the bores in said first elements, said second elements extending through bores of the fifth elements, and said tubular elements spacing the fifth elements axially on said second elements.

* * * * *